US007984984B2

(12) United States Patent
Kitahara

(10) Patent No.: US 7,984,984 B2
(45) Date of Patent: Jul. 26, 2011

(54) JAM PROCESSING APPARATUS FOR PRINTER AND METHOD THEREOF

(75) Inventor: Toshihiro Kitahara, Tachikawa (JP)

(73) Assignee: Olympus Corporation, Tokyo (JP)

( * ) Notice: Subject to any disclaimer, the term of this patent is extended or adjusted under 35 U.S.C. 154(b) by 1286 days.

(21) Appl. No.: 11/582,931

(22) Filed: Oct. 18, 2006

(65) Prior Publication Data

US 2007/0035605 A1 Feb. 15, 2007

Related U.S. Application Data

(63) Continuation of application No. PCT/JP2005/021164, filed on Nov. 17, 2005.

(30) Foreign Application Priority Data

Nov. 18, 2004 (JP) ..... 2004-334734

(51) Int. Cl.
*B41J 2/01* (2006.01)
*B41J 29/38* (2006.01)

(52) U.S. Cl. ..... 347/104; 347/16; 347/101

(58) Field of Classification Search ..... 347/104, 347/14, 16, 19, 30, 101
See application file for complete search history.

(56) References Cited

U.S. PATENT DOCUMENTS 4,368,973 A * 1/1983 Silverberg ..... 399/373
4,520,726 A * 6/1985 Rouly et al. ..... 101/123
4,786,041 A * 11/1988 Acquaviva et al. ..... 271/3.13
4,825,255 A * 4/1989 Iaia et al. ..... 355/76
4,831,419 A * 5/1989 Iaia et al. ..... 355/76
4,887,101 A * 12/1989 Hirose et al. ..... 346/134
4,997,178 A * 3/1991 Ogoda ..... 271/276
5,166,735 A * 11/1992 Malachowski ..... 399/68
5,225,853 A * 7/1993 Kobayashi et al. ..... 347/33
5,274,399 A * 12/1993 Uchida et al. ..... 346/134
5,526,028 A * 6/1996 Rottman ..... 347/23
5,712,672 A * 1/1998 Gooray et al. ..... 347/102
5,893,554 A * 4/1999 Okahashi et al. ..... 271/98
5,967,510 A * 10/1999 Ono et al. ..... 271/196
6,336,722 B1 * 1/2002 Wotton et al. ..... 347/102
6,578,945 B2 * 6/2003 Hashi et al. ..... 347/22
7,128,389 B2 * 10/2006 Okamoto et al. ..... 347/29
2002/0109768 A1 * 8/2002 Greive ..... 347/104
2004/0089994 A1 * 5/2004 Koga et al. ..... 271/98

FOREIGN PATENT DOCUMENTS

JP 57062147 A * 4/1982

(Continued)

OTHER PUBLICATIONS

Notification Concerning Transmittal of International Preliminary Report on Patentability, Chapter I of the Patent Cooperation Treaty, and Written Opinion of the International Searching Authority, Dated May 31, 2007 for PCT/JP2005/021164, 5 sheets.

(Continued)

*Primary Examiner* — Stephen D Meier
*Assistant Examiner* — Leonard S Liang
(74) *Attorney, Agent, or Firm* — Holtz, Holtz, Goodman & Chick, PC

(57) ABSTRACT

When a jam occurs between respective inkjet recording heads and a belt platen, the belt platen is moved down to a preset lower limit position, and a suction fan is rotated to suck and hold a recording medium onto a carrying belt.

17 Claims, 7 Drawing Sheets

FOREIGN PATENT DOCUMENTS

| | | | | |
|---|---|---|---|---|
| JP | 64002069 | A | * | 1/1989 |
| JP | 64-40848 | A | | 2/1989 |
| JP | 02043144 | A | * | 2/1990 |
| JP | 2-106765 | A | | 4/1990 |
| JP | 3-243356 | A | | 10/1991 |
| JP | 03-243356 | B2 | | 10/1991 |
| JP | 5-238588 | A | | 9/1993 |
| JP | 2002-154711 | A | | 5/2002 |
| JP | 2002-192799 | A | | 7/2002 |
| JP | 2003-165205 | A | | 6/2003 |
| JP | 2004-309714 | A | | 11/2004 |

OTHER PUBLICATIONS

Japanese Office Action dated Jul. 13, 2010 and English translation thereof, issued in counterpart Japanese Application No. 2006-545143.

* cited by examiner

JAM PROCESSING APPARATUS FOR PRINTER AND METHOD THEREOF

CROSS REFERENCE TO RELATED APPLICATIONS

This is a Continuation Application of PCT Application No. PCT/JP2005/021164, filed Nov. 17, 2005, which was published under PCT Article 21(2) in Japanese.

This application is based upon and claims the benefit of priority from prior Japanese Patent Application No. 2004-334734, filed Nov. 18, 2004, the entire contents of which are incorporated herein by reference.

BACKGROUND OF THE INVENTION

1. Field of the Invention

The present invention relates to a printer having an inkjet recording head which discharges an ink and a carrying mechanism which carries a recording medium, and specifically relates to a jam processing apparatus for a printer in which an operation of removing a recording medium jammed between an inkjet recording head and a carrying mechanism has been improved, and a method thereof.

2. Description of the Related Art

Inkjet recording apparatuses are generally classified into serial mode types and line mode types in accordance with a recording mode of recording an image on a recording medium such as a recording paper sheet. In the serial mode type, an inkjet recording head which discharges an ink is mounted on a carriage, and a recording medium is carried by a carrying mechanism. The carriage scans in a width direction of the recording medium in synchronization with carriage of the recording medium by the carrying mechanism. The inkjet recording head discharges the ink simultaneously with scanning by the carriage. As a result, recording is performed on the recording medium.

In the line mode type, a plurality of inkjet recording heads are arranged in a width direction of a recording medium to be carried, and the recording medium is carried by a carrying mechanism. Each inkjet recording head discharges an ink in synchronization with carriage of the recording medium. As a result, recording is carried out on the recording medium. In the line mode, likewise, the plurality of inkjet recording heads are mounted on a carriage, and the carriage scans in the width direction of the recording medium in synchronization with carriage of the recording medium, thereby increasing a speed of a recording operation.

In an inkjet recording apparatus adopting the line mode, a plurality of inkjet recording heads are fixed and arranged, and a recording medium is passed below each inkjet recording head to perform a recording operation. In such a recording apparatus, the recording medium may jam between each inkjet recording head and the carrying mechanism (which will be referred to as a jam hereinafter) during a recording operation on the recording medium in some cases.

When a jam occurs, the inkjet recording apparatus interrupts a recording operation. The inkjet recording apparatus then separates each inkjet recording head from the carrying mechanism. As a result, the recording medium which has generated the jam is automatically or manually removed.

BRIEF SUMMARY OF THE INVENTION

According to a major aspect of the present invention, there is provided a jam processing apparatus for a printer, comprising a recording head which records an image with respect to a recording medium, a carrying belt which is arranged to face the recording head, and holds and carries the recording medium, a carrying belt driving portion which moves the carrying belt in at least a direction apart from the recording head, and a recording medium holding portion which holds the recording medium on the carrying belt when the carrying belt driving portion moves the carrying belt in the direction apart from the recording head.

According to a major aspect of the present invention, there is provided a jam processing method for a printer, having, sucking a recording medium onto a carrying belt, carrying the recording medium facing a recoding head, recording an image on the carried recording medium by the recording head, detecting whether a carriage defect of the recording medium has occurred, separating the carrying belt from the recording head when the carriage defect has occurred, and generating a suction force in the carrying belt when the carrying belt is separated from the recording head.

DETAILED DESCRIPTION OF THE INVENTION

A first embodiment according to the present invention will now be described hereinafter with reference to the accompanying drawings.

Figure 1:
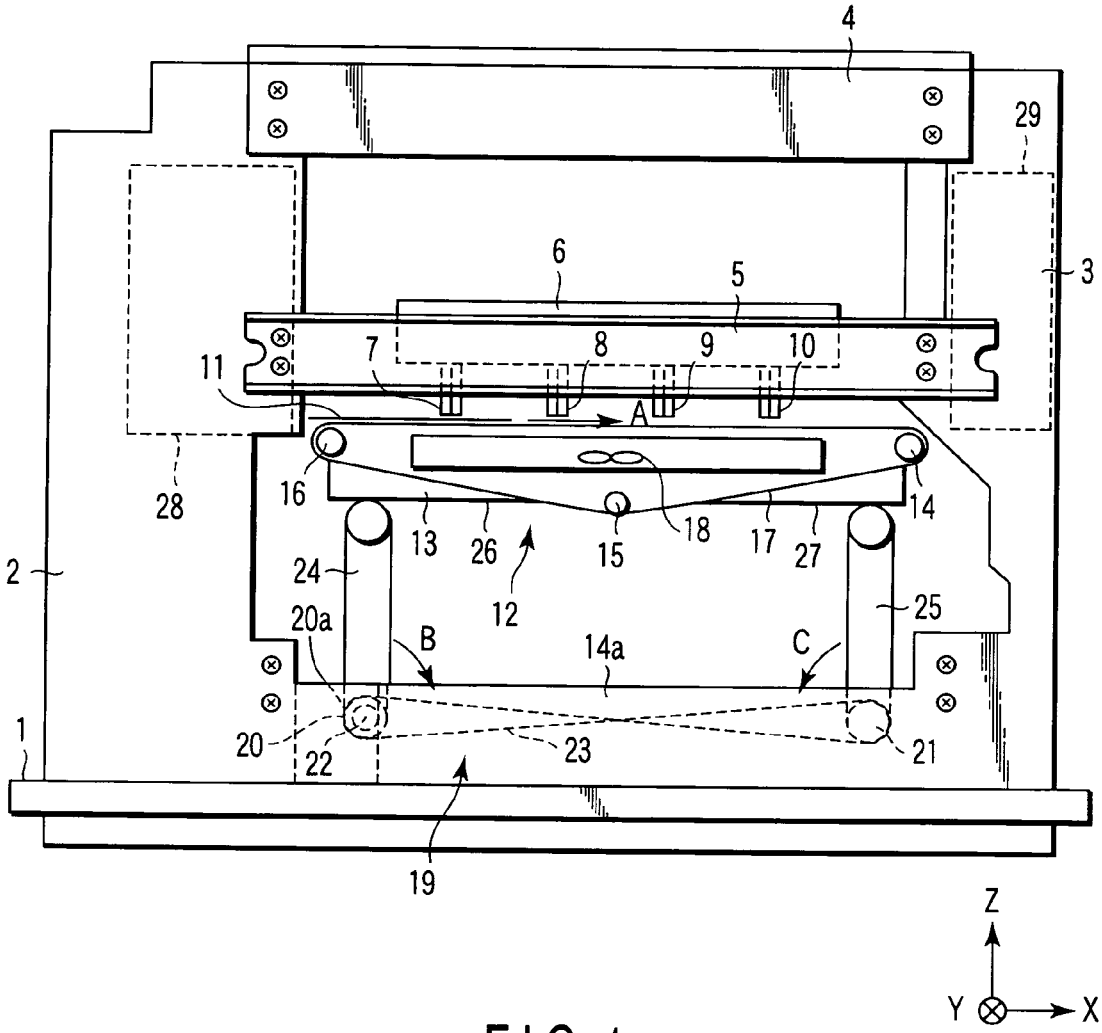
FIG. 1 is a block diagram showing a first embodiment of an inkjet recording apparatus according to the present invention.

FIG. 1 is a block diagram of an inkjet recording apparatus. A base frame 1 is provided in an apparatus main body. Respective support frames 2 and 3 are provided on the base frame 1. The respective support frames 2 and 3 are coupled with each other through respective coupling frames 4 and 5. Each pair of support frames 2 and 3 is provided on each of both side surfaces. The respective support frames 2 and 3 are coupled on both lateral surface sides through the respective coupling frames 4 and 5.

A carriage 6 is provided on each coupling frame 5. A plurality of inkjet recording heads 7 to 10 are mounted in the carriage 6. The respective inkjet recording heads 7 to 10 discharge inks of respective colors, e.g., K (black), C (cyan), M (magenta) and Y (yellow). The respective inkjet recording heads 7 to 10 are provided along a carrying direction A (an X direction) of a recording medium 11 at predetermined intervals. Each of the inkjet recording heads 7 to 10 has a plurality of nozzles linearly arranged along a vertical direction (a Y direction) with respect to the carrying direction A of the recording medium 11. The plurality of inkjet recording heads 7 to 10 are arranged in accordance with respective colors of KCMY.

A belt platen 12 is provided below the carriage 6. The belt platen 12 rotatably supports, e.g., three cylindrical rollers 14 to 16 with respect to a platen frame 13. A carrying belt 17 is wound around the respective rollers 14 to 16. The roller 14 is a driving roller 14. The roller 15 is a stretching roller 15. The roller 16 is a driven roller 16.

The carrying belt 17 is formed into an endless band-like shape. The carrying belt 17 holds the recording medium 11 such as a recording paper sheet on a surface thereof. A plurality of suction holes are provided in the carrying belt 17. A suction fan 18 is provided in the belt platen 12. The suction fan 18 takes in air when driven to rotate. Therefore, air is taken in from the plurality of suction holes in the carrying belt 17. The recording medium 11 is sucked and held on the carrying belt 17 by air intake.

The belt platen 12 moves up and down in a vertical direction (a Z direction) by an elevating operation of a platen elevating mechanism 19. In the case of moving down the belt platen 12, the platen elevating mechanism 19 separates the respective inkjet recording heads 7 to 10 from the belt platen 12. As a result, the platen elevating mechanism 19 serves as a carrying belt driving portion.

The platen elevating mechanism 19 will now be concretely described. The platen elevating mechanism 19 is provided below the belt platen 12. A platen rotation driving shaft 20 and a platen rotation driven shaft 21 are provided to the platen elevating mechanism 19. The platen rotation driving shaft 20 is provided on an upstream (supply) side of the belt platen 12. The platen rotation driven shaft 21 is provided on a downstream (ejection) side of the belt platen 12. An elevation driving motor 22 is coupled with the platen rotation driving shaft 20. A driving belt 23 is crossed and stretched between the platen rotation driving shaft 20 and the platen rotation driven shaft 21.

A platen support arm 24 is coupled with the platen rotation driving shaft 20. A platen support arm 25 is coupled with the platen rotation driven shaft 21. The platen support arm 24 can rotate in a direction indicated by an arrow B around the platen rotation driving shaft 20 with rotation of the platen rotation driving shaft 20. The platen support arm 25 can rotate in a direction indicated by an arrow C around the platen rotation driven shaft 21 with rotation of the platen rotation driven shaft 21. An end portion of the platen support arm 24 is in contact with a platen support guide 26. An end portion of the platen support arm 25 is in contact with a platen support guide 27. The respective platen support guides 26 and 27 are provided at a lower end of the platen frame 13.

Therefore, when the elevation driving motor 22 drives to rotate, the platen rotation driving shaft 20 rotates. The driving belt 23 moves in response to rotation of the platen rotation driving shaft 20. The platen rotation driven shaft 21 rotates in response to a movement of the driving belt 23. As a result, the platen rotation driving shaft 20 and the platen rotation driven shaft 21 rotate in opposite directions in synchronization with each other. The platen support arm 24 rotates in the direction indicated by the arrow B around the platen rotation driving shaft 20 by rotation of the platen rotation driving shaft 20 and the platen rotation driven shaft 21. In synchronization with this rotation, the platen support arm 25 rotates in the direction indicated by the arrow C around the platen rotation driven shaft 21. Therefore, the belt platen 12 mounted at the end portions of the respective platen support arms 24 and 25 moves up and down in the vertical direction (the Z direction) by rotation of the respective platen support arms 24 and 25.

A medium supply unit 28 supplies the recording medium 11 to the belt platen 12.

A medium ejection unit 29 ejects the recording medium 11 carried by the belt platen 12 to the outside of the apparatus main body. The recording medium 11 which is ejected to the outside has an image recorded thereon. An image is recorded on the recording medium 11 by spotting inks of respective colors, i.e., KCMY discharged from the respective inkjet recording heads 7 to 10.

Figure 2:
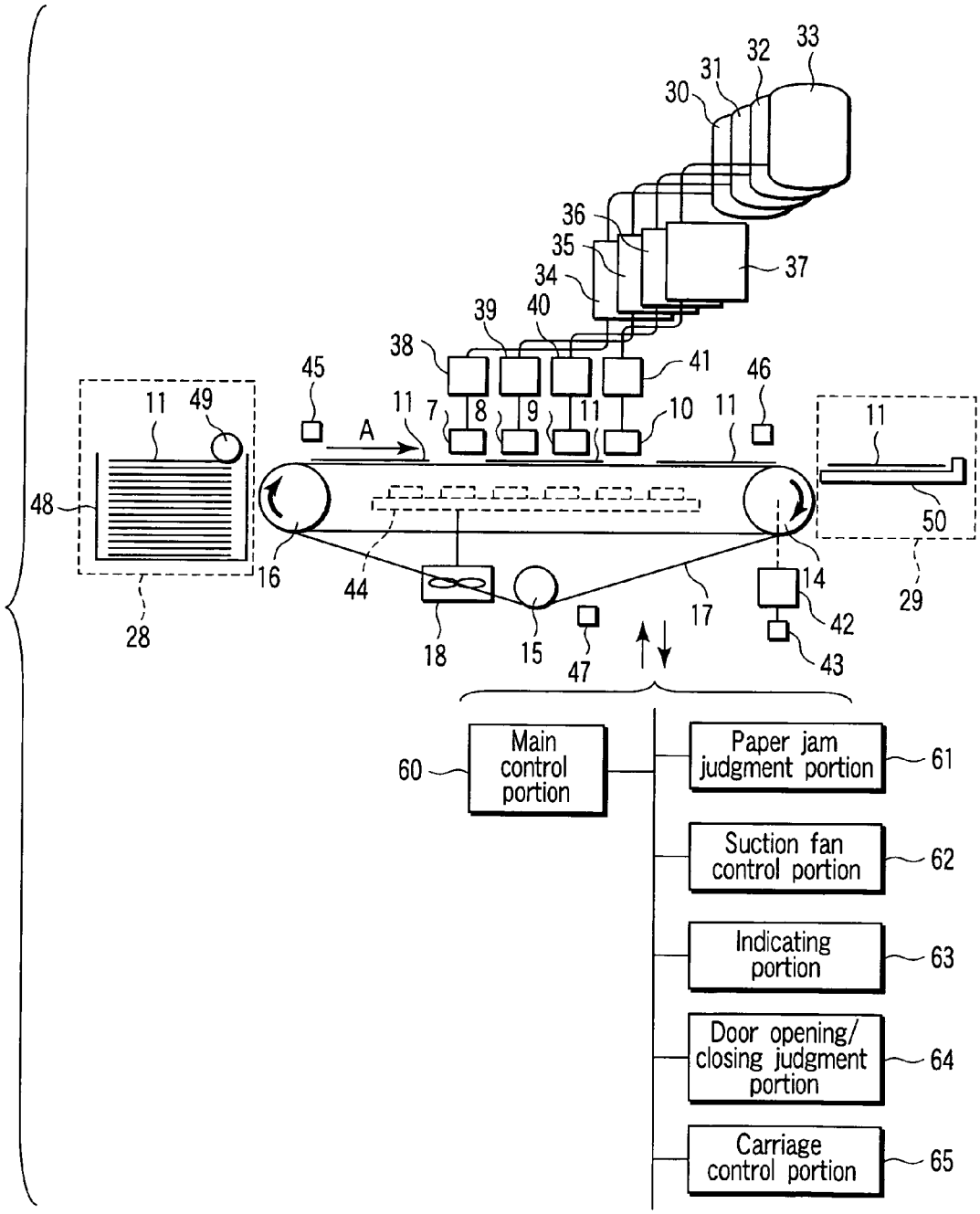
FIG. 2 is a block diagram showing a primary part of the apparatus.

FIG. 2 is a block diagram of a primary part of the inkjet recording apparatus. Respective ink tanks 30 to 33 are provided. The respective ink tanks 30 to 33 accommodate inks of respective colors, i.e., KCMY. The respective ink tanks 30 to 33 communicate with respective distributors 38 to 41 for the respective colors of KCMY through respective reservoir tanks 34 to 37 for the respective colors of KCMY. The respective distributors 38 to 41 distribute the inks to the respective inkjet recording heads 7 to 10 in accordance with the respective colors of KCMY.

A platen driving motor 42 is coupled with the driving roller 14 in the belt platen 12. The driving roller 14 rotates by rotational driving of the platen driving motor 42. The carrying belt 17 moves at a fixed speed in a state where it is stretched between the respective rollers 14 to 16 in response to rotation of the driving roller 14. When the recording medium 11 is supplied onto the carrying belt 17 in this state, the recording medium 11 is carried in the X direction at a fixed speed with movement of the carrying belt 17. Therefore, the medium supply unit 28 side is an upstream (supply) side for carrying the recording medium 11. The medium ejection unit 29 side is a downstream (ejection) side.

An encoder 43 is coupled with a rotary shaft of the platen driving motor 42. The encoder 43 outputs a revolution number detection signal according to the number of revolutions of the platen driving motor 42.

A suction portion 44 is provided to the suction fan 18. The suction portion 44 is provided below the carrying belt 17. The suction portion 44 makes uniform the suction force of air taken in through each suction hole of the carrying belt 17.

A first paper sensor 45 is provided on the upstream (supply) side of the belt platen 12. A second paper sensor 46 is provided on a downstream (ejection) side of the belt platen 12. The first paper sensor 45 detects presence/absence of the recording medium 11, and outputs a first detection signal indicative of presence/absence of the recording medium 11. The second paper sensor 46 detects presence/absence of the recording medium 11, and outputs a second detection signal indicative of presence/absence of the recording medium 11.

A lower limit sensor 47 is provided below the belt platen 12. When the belt platen has moved down by the platen elevating mechanism 19, the lower limit sensor 47 detects that the belt platen 12 has reached a preset lower limit position, and outputs its lower limit reaching signal. Reaching the preset lower limit position means that the respective inkjet recording heads 7 to 10 and the belt platen 12 are separated from each other with a preset gap therebetween.

The medium supply unit 28 has a cassette 48 which accommodates the plurality of recording mediums 11. The respective recording mediums 11 accommodated in the cassette 48 are supplied to the belt platen 12 one by one by rotation of a supply roller 49.

The medium ejection unit 29 has a cassette 50 which accommodates the recording mediums 11 ejected to the outside of the apparatus main body.

Figure 3:
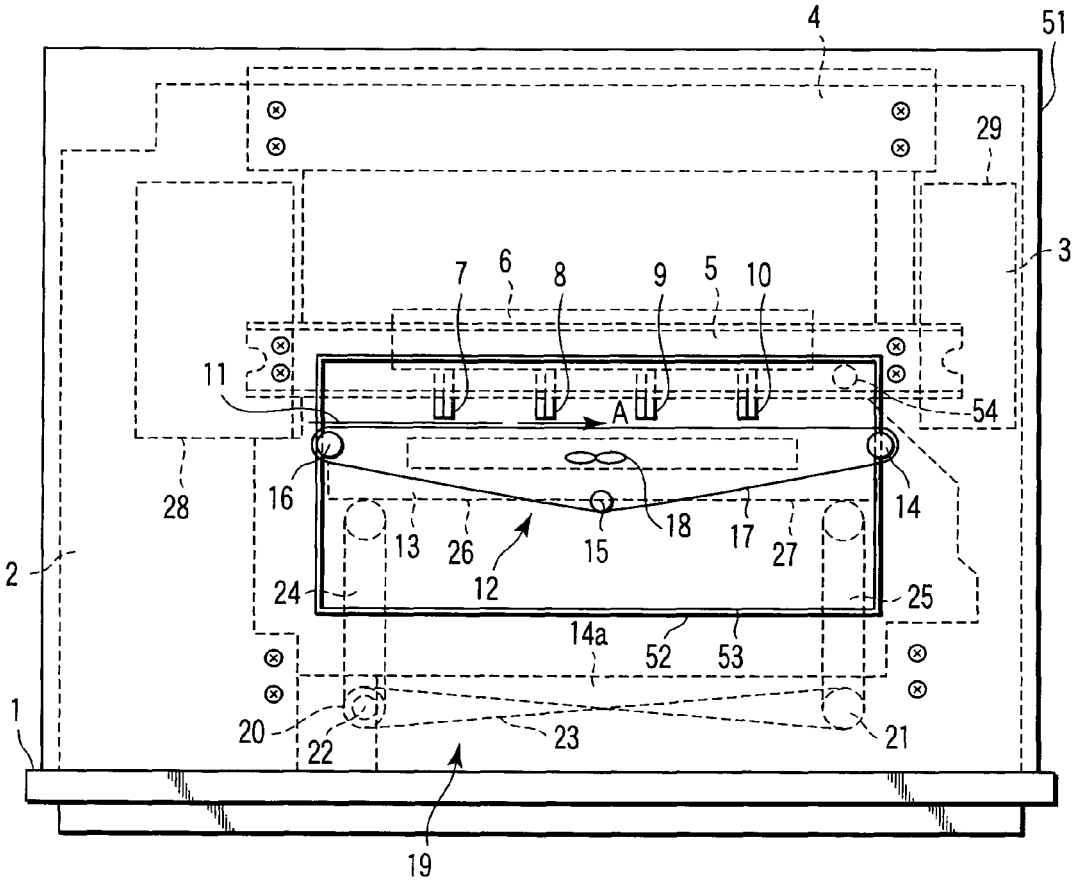
FIG. 3 is a view showing a door provided to an exterior cover in the apparatus.

As shown in FIG. 3, the inkjet recording apparatus has an exterior case 51. The exterior case 51 covers and accommodates the respective support frames 2 and 3, the respective coupling frames 4 and 5, the carriage 6 which mounts the respective inkjet recording heads 7 to 10 therein, the belt platen 12, the respective ink tanks 30 to 33, the respective reservoir tanks 34 to 37 and the respective distributors 38 to 41.

An opening 52 is provided in the exterior case 51. The opening 52 is provided at a position from which the recording medium 11 which has jammed between the respective inkjet recording heads 7 to 10 and the belt platen 12 can be taken out. The belt platen 12 is moved down to the preset lower limit position by the platen elevating mechanism 19. An upper surface of the carrying belt 17 faces the respective inkjet recording heads 7 to 10. The opening 52 is formed to have a size which allows viewing the respective inkjet recording heads 7 to 10 and the upper surface of the carrying belt 17 which has moved down to the preset lower limit position.

A door 53 is openably disposed to the opening 52. When the door 53 is closed with respect to the opening 52, it covers the entire opening 52. The door 53 is rotatably attached at a lower portion of the opening 52 through a hinge, for example.

A door opening/closing sensor (a door sensor) 54 is provided to the door 53 as shown in FIG. 3. The door opening/closing sensor 54 is provided on, e.g., a side of the door 53 opposite to the side where the hinge is disposed, i.e., an upper portion of the door 53. The door opening/closing sensor 54 detects opening/closing of the door 53, and outputs a door opening detection signal or a door closing detection signal. The door opening detection signal or the door closing detection signal is transmitted to a main control portion 60.

A control system will now be described. The main control portion 60 has a CPU, a RAM, a ROM, an input/output port and others. The ROM stores a recording operation program therein. The recording operation program is a series of recording operations of carrying the recording medium 11 by the belt platen 12 and discharging the inks having the respective colors of KCMY from the respective inkjet recording heads 7 to 10 to carry out recording on the recording medium 11.

The ROM stores a suction/holding program. According to the suction/holding program, the belt platen 12 is moved down by the platen elevating mechanism 19, and suction/holding of the recording medium 11 by the belt platen 12 is maintained while the respective inkjet recording heads 7 to 10 are separated from the belt platen 12.

The ROM stores a jam processing program. According to the jam processing program, whether a jam has occurred in carriage of the recording medium 11 is detected. When the jam has occurred, the carrying belt 17 is separated from the respective inkjet recording heads 7 to 10, and the suction fan 18 is driven to produce a suction force in the carrying belt 17 while the carrying belt 17 is separated from the respective inkjet recording heads 7 to 10.

The main control portion 60 performs operation control of the entire inkjet recording apparatus. When a jam has occurred, the main control portion 60 executes the jam processing program stored in the ROM. The main control portion 60 executes the jam processing program to operate a paper jam judgment portion 61, a suction fan control portion (a recording medium holding portion) 62 and a door opening/closing judgment portion 64.

The main control portion 60 will now be concretely described. The main control portion 60 controls the platen elevating mechanism 19, the paper jam judgment portion 61, the suction fan control portion 62, an indicating portion 63, the door opening/closing judgment portion 64 and a carriage control portion 65 based on respective output signals from the first paper sensor 45, the second paper sensor 46, the door opening/closing sensor 54 and others.

The main control portion 60 issues an upward movement start command, an upward movement stop command, a downward movement start command or a downward movement stop command to the platen elevating mechanism 19. The main control portion 60 issues a carriage start command or a carriage stop command with respect to the carriage control portion 65. The main control portion 60 issues a suction force maintenance command, a suction force reduction command, a suction force increase command, a command of restoring a suction force, a command of setting a suction force to be equal to that in image recording, a suction stop command and others to the suction fan control portion 62. The main control portion 60 issues a command of indicating occurrence of a jam and a command of indicating that removal of a jammed paper is possible to the indicating portion 63.

The paper jam judgment portion 61 receives a first detection signal indicative of presence/absence of the recording medium 11 output from the first paper sensor 45. The paper jam judgment portion 61 receives a second detection signal indicative of presence/absence of the recording medium 11 output from the second paper sensor 46. The paper jam judgment portion 61 judges whether the second detection signal from the second paper sensor 46 is received after a fixed time from acceptance of the first detection signal from the first paper sensor 45. When the second detection signal is received after the fixed time from acceptance of the first detection signal, the paper jam judgment portion 61 determines that carriage of the recording medium 11 is normally performed. When the second detection signal is not received after the fixed time from acceptance of the first detection signal, the paper jam judgment portion 61 determines that a jam has occurred.

The suction fan control portion 62 sets the number of revolutions of the suction fan 18 while the belt platen 12 is moving down, i.e., while the respective inkjet recording heads 7 to 11 are being relatively separated from the belt platen 12. The number of revolutions of the suction fan 18 is set by the suction fan control portion 62 based on various kinds of commands input from the main control portion 60. As a result, a suction force which sucks the recording medium 11 on the carrying belt 17 is appropriately set in accordance with the number of revolutions of the suction fan 18. For example, when a suction force maintenance command is issued from the main control portion 60 to the suction fan control portion 62, the suction fan control portion 62 maintains the number of revolutions of the suction fan 18 which has been set immediately before receiving the suction force maintenance command. As a result, the suction force of sucking the recording medium 11 on the carrying belt 17 is maintained as it is.

Upon receiving a suction force reduction command from the main control portion 60, the suction fan control portion 62 sets the number of revolutions of the suction fan 18 to a preset reduced number of revolutions which is smaller than the number of revolutions of the suction fan 18 during the image recording operation. As a result, a suction force of sucking the recording medium 11 on the carrying belt 17 is reduced to be smaller than the suction force during the image recording operation.

Upon receiving a suction force increase command from the main control portion 60, the suction fan control portion 62 sets the number of revolutions of the suction fan 18 to a preset increased number of revolutions which is larger than that during the recording operation. As a result, a suction force of sucking the recording medium 11 on the carrying belt 17 is increased to be larger than that during the image recording operation.

When the suction fan control portion 62 receives a command of restoring a suction force from the main control portion 60, it restores the number of revolutions of the suction fan 18 to the same number of revolutions as that during the recording operation. In this case, even if the suction fan 18 rotates with the preset reduced number of revolutions or the preset increased number of revolutions, the suction fan control portion 62 sets the number of revolutions of the suction fan 18 to the same number of revolutions as that during the recording operation.

The indicating portion 63 indicates "occurrence of a jam", "removal of a jammed paper" or the like upon receiving a command of indicating occurrence of a jam or a command of removing a jammed paper from the main control portion 60. The indicating portion 63 is, e.g., a liquid crystal display or a lamp. It is to be noted that the indicating portion 63 may inform occurrence of a jam by using tones from, e.g., an alarm.

The door opening/closing judgment portion 64 receives a door opening detection signal or a door closing detection signal output from the door opening/closing sensor 54, and judges whether the door 53 is opened/closed.

Figure 4:
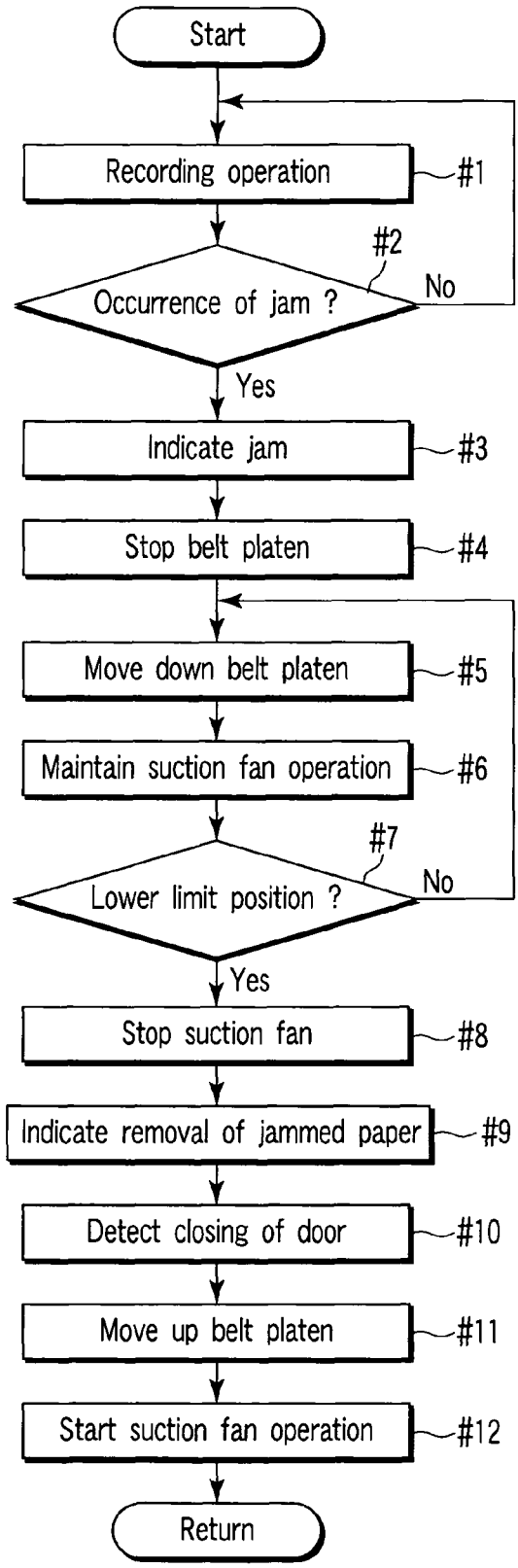
FIG. 4 is a jam processing flowchart in the apparatus.

Jam processing of the thus configured apparatus will now be described with reference to a jam processing flowchart depicted in FIG. 4.

The main control portion 60 performs a regular recording operation with respect to the recording medium at a step #1. The main control portion 60 executes a recording operation program recorded in the ROM. As a result, the main control portion 60 issues a carriage start command to the carriage control portion 65, and issues a suction start command to the suction fan control portion 62.

The carriage control portion 65 receives the carriage start command from the main control portion 60. The carriage control portion 65 rotates the platen driving motor 42 based on the carriage start command. The carriage control portion 65 sets the number of revolutions of the platen driving motor 42 so that a carrying speed of the recording medium 11 becomes an image recording speed. The driving roller 14 is rotated by rotational driving of the platen driving motor 42. The carrying belt 17 moves at a fixed speed in a state where it is stretched between the respective rollers 14 and 16 in response to rotation of the driving roller 14.

The suction fan control portion 62 receives the suction start command from the main control portion 60. The suction fan control portion 62 drives the suction fan 18 based on the suction start command. The suction fan control portion 62 sets the number of revolutions of the suction fan 18 in such a manner that the suction fan 18 provides an image recording suction force. As a result, air is taken in through the respective suction holes formed in the carrying belt 17. A distribution of the suction force on the carrying belt 17 is uniform.

When the supply roller 49 rotates in this state, the recording mediums 11 accommodated in the cassette 48 are supplied onto the carrying belt 17 of the belt platen 12 one by one. At this time, since air is sucked through the respective suction holes formed in the carrying belt 17 by rotation of the suction fan 18, the recording medium 11 is sucked and held on the moving carrying belt 17. As a result, the recording medium 11 is sucked and held on the carrying belt 17, and carried in the direction indicated by the arrow A at a fixed speed.

When the recording medium 11 is carried to a part below the respective inkjet recording heads 7 to 10, the respective inkjet recording heads 7 to 10 discharge the inks having the respective colors, i.e., K, C, M and Y. Each ink is spotted on the recording medium 11 which is carried at a fixed speed. As a result, an image or the like is recorded on the recording medium 11.

The recording medium 11 having an image recorded thereon is sucked and held on the carrying belt 17 and carried to the downstream side. The recording mediums 11 having images recorded thereon are accommodated in the cassette 50 one by one.

At the time of such a recording operation, the first paper sensor 45 detects presence/absence of the recording medium 11 supplied from the cassette 48 to the belt platen 12, and outputs a first detection signal indicative of presence/absence of the recording medium 11. The second paper sensor 46 detects presence/absence of the recording medium 11 accommodated in the cassette 50 from the belt platen 12, and outputs a second detection signal indicative of presence/absence of the recording medium 11.

At a step #2, the paper jam judgment portion 61 receives a first detection signal indicative of presence/absence of the recording medium 11 output from the first paper sensor 45. Then, the paper jam judgment portion 61 receives a second detection signal indicative of presence/absence of the recording medium 11 output from the second paper sensor 46. The paper jam judgment portion 61 judges whether the second detection signal from the second paper sensor 46 is received after a fixed time from acceptance of the first detection from the first paper sensor 45.

When the second detection signal is received after the fixed time from acceptance of the first detection signal from the first paper sensor 45 as a result of this judgment, the paper jam judgment portion 61 determines that carriage of the recording medium 11 is normally performed.

Figure 5:
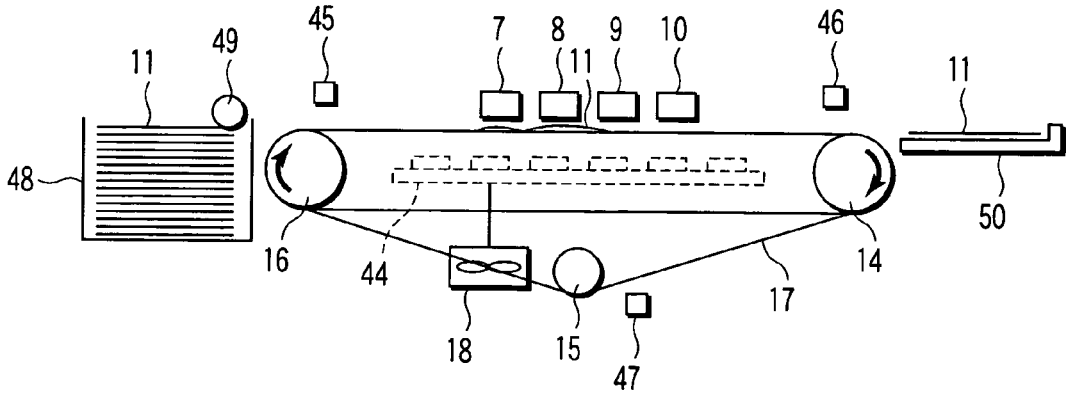
FIG. 5 is a view showing a state of occurrence of a jam in the apparatus.

When the second detection signal is not received after the fixed time from acceptance of the first detection signal from the first paper sensor 45, the paper jam judgment portion 61 determines that carriage of the recording medium 11 has failed. That is, for example, the paper jam judgment portion 61 determines that the recording medium 11 has jammed between the respective inkjet recording heads 7 to 10 and the belt platen 12 as shown in FIG. 5, and transmits a paper carriage error signal to the main control portion 60.

The main control portion 60 receives the paper carriage error signal from the paper jam detecting portion 61. At a step #3, the main control portion 60 issues a command of indicating occurrence of a jam to the indicating portion 63 upon receiving the paper carriage error signal. As a result, the indicating portion 63 indicates "occurrence of a jam".

Then, at a step #4, the main control portion 60 issues a carriage stop command to the carriage control portion 65. Upon receiving the carriage stop command, the carriage control portion 65 stops the platen driving motor 42 of the belt platen 12. The belt platen 12 stops movement of the carrying belt 17 in response to stop of the platen driving motor 42. As a result, carriage of the recording medium 11 is stopped.

Then, at a step #5, the main control portion 60 issues a downward movement start command to the platen elevating mechanism 19. As a result, the elevation driving motor 22 in the platen elevating mechanism 19 rotates. The driving belt 23 moves in response to rotation of the elevation driving motor 22. The platen rotation driven shaft 21 rotates in response to movement of the driving belt 23. At this time, the platen rotation driving shaft 20 and the platen rotation driven shaft 21 rotate in opposite directions in synchronization with each other.

Figure 6:
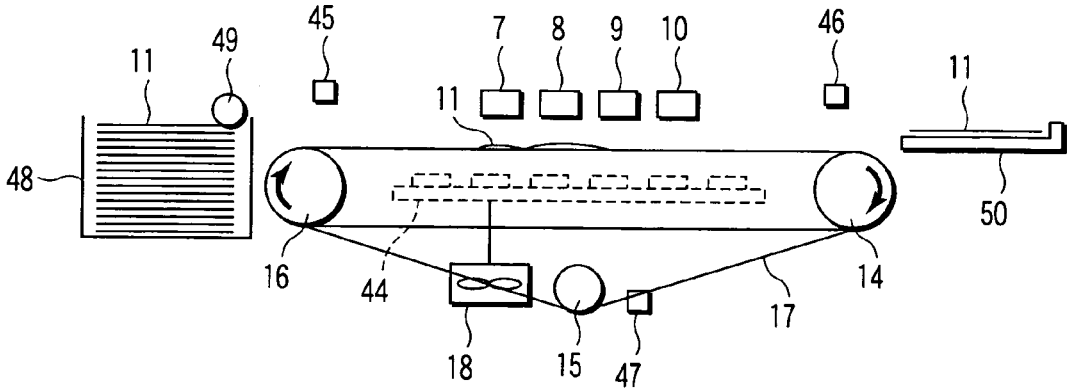
FIG. 6 is a view showing a state in which each inkjet recording head is separated from a belt platen in the apparatus.

One platen support arm 24 swivels (swivels in a clockwise direction) along the direction indicated by the arrow B around the platen rotation driving shaft 20. The other platen support arm 25 swivels (swivels in a counterclockwise direction) along the direction indicated by the arrow C around the platen rotation driven shaft 21. As a result, the belt platen 12 mounted at the end portions of the respective platen support arms 24 and 25 moves down as shown in FIG. 6.

In addition to this operation, at a step #6, the main control portion 60 issues a suction force maintenance command to the suction fan control portion 62. The suction fan control portion 62 maintains the number of revolutions set immediately before acceptance of the suction force maintenance command as it is. As a result, the suction fan 18 keeps rotating with the same number of revolutions as that during the recording operation. The suction force of sucking the recording medium 11 on the carriage belt 17 is maintained as it is.

Therefore, while the belt platen 12 is moving down, a state in which the same suction force as that during the image recording operation is generated on the carrying belt 17 is continuously maintained. The jammed recording medium 11 is sucked onto the carrying belt 17, and moves down together with the carrying belt which is moving down.

When the belt platen 12 has reached a preset lower limit position, the lower limit sensor 47 detects that the belt platen 12 has reached the preset lower limit position, and outputs a lower limit reaching signal to the main control portion 60.

At a step #7, the main control portion 60 judges whether the lower limit reaching signal output from the lower limit sensor 47 has been received. When the lower limit reaching signal from the lower limit sensor 47 is input to the main control portion 60, the main control portion 60 issues a downward movement stop command to the elevation driving motor 22 of the platen elevating mechanism 19. The elevation driving motor 22 of the platen elevating mechanism 19 stops rotation. The downward movement of the belt platen 12 is stopped.

As a result, the respective inkjet recording heads 7 to 10 and the belt platen 12 are separated from each other with a preset gap therebetween. The separation gap is set to an extent that a sufficient space for performing the jam processing operation is assured.

When the lower limit reaching signal from the lower limit sensor 47 is input to the main control portion 60, the main control portion 60 issues a suction stop command to the suction fan control portion 62 at a step #8. As a result, the suction fan control portion 62 stops rotation of the suction fan 18. Consequently, the suction force on the carrying belt 17 becomes zero.

At a step #9, the main control portion 60 issues a command of indicating that removal of a jammed paper is possible to the indicating portion 63. As a result, the indicating portion 63 indicates that "a jammed paper can be removed" or "the door can be opened".

An operator confirms contents of indication by the indicating portion 63. The operator opens the door 53. For example, the operator inserts through the opening portion 52 his/her hand into a space between the respective inkjet recording heads 7 to 10 and the belt platen 12 separated from each other, thereby removing the jammed recording medium 11 present on the carrying belt 17 of the belt platen 12.

While the door 53 is opened, the door opening/closing sensor 54 outputs a door opening detection signal. The door opening detection signal is transmitted to the door opening/closing judgment portion 64. The door opening/closing judgment portion 64 receives the door opening detection signal output from the door opening/closing sensor 54, and determines that the door 53 is opened.

While the door 53 is opened, the main control portion 60 does not drive the suction fan 18 and the elevation driving motor 22. When removal of the jammed recording medium 11 by the operator is finished, the operator closes the door 53.

When the door 53 is closed, the door opening/closing sensor 54 detects that the door 53 is closed, and outputs a door closing detection signal. The door closing detection signal is transmitted to the door opening/closing judgment portion 64. At a step #10, the door opening/closing judgment portion 64 receives the door closing detection signal, and determines that the door 53 is closed.

When the door 53 is closed, the main control portion 60 issues an upward movement start command to the platen elevating mechanism 19 at a step #11. The platen elevating mechanism 19 rotates the elevation driving motor 22 upon receiving the upward movement command. One platen support arm 24 swivels (swivels in the counterclockwise direction) in a direction opposite to the arrow B around the platen rotation driving shaft 20 by rotation of the elevation driving motor 22.

In addition to this operation, the driving belt 23 moves in response to rotation of the elevation driving motor 22. The platen rotation driven shaft 21 rotates in response to movement of the driving belt 23. At this time, the platen rotation driving shaft 20 and the platen rotation driven shaft 21 rotate in opposite directions in synchronization with each other. As a result, the other platen support arm 25 swivels (swivels in the clockwise direction) in a direction opposite to the arrow C around the platen rotation driven shaft 21.

Consequently, the belt platen 12 mounted at the end portions of the respective platen support arms 24 and 25 moves up. The belt platen 12 returns to a state where the regular recording operation is possible as shown in FIG. 2.

Then, at a step #12, the main control portion 60 issues a suction start command to the suction fan control portion 62. The suction fan control portion 62 drives the suction fan 18 based on the suction start command.

Again returning to the step #1, the main control portion 60 performs the regular recording operation with respect to the recording medium 11.

As described above, according to the first embodiment, when the recording medium 11 jams between the respective inkjet recording heads 7 to 10 and the belt platen 12 and carriage of the recording medium 11 enters an abnormal state, carriage of the recording medium 11 is stopped and the belt platen 12 is moved down. While the belt platen is moved down, the suction fan 18 is rotated to generate a suction force which can suck and hold the recording medium 11 on the carrying belt 17. In this state, the belt platen 12 is moved down to the preset lower limit position, i.e., a jam processing operating position.

As a result, the jammed recording medium 11 is sucked and held on the carrying belt 17 by the suction force generated by driving of the suction fan 18, and moves down together with the carrying belt 17. Therefore, an operator can insert, e.g., his/her hand into a space between the respective inkjet recording heads 7 to 10 and the belt platen 12 separated from each other with a preset gap therebetween. Then, the operator inserts his/her hand into the space between the respective inkjet recording heads 7 to 10 and the belt platen 12, thereby readily removing the jammed recording medium 11 present on the carrying belt 17 of the belt platen 12 without touching the respective inkjet recording heads 7 to 10. Furthermore, when removing the jammed recording medium 11, since rotation of the suction fan 18 is stopped, the suction force is not generated on the carrying belt 17, whereby the operator can readily remove the jammed recording medium 11.

A modification of the first embodiment will now be described.

The main control portion 60 indicates "occurrence of a jam" in the indicating portion 63 when the paper jam judgment portion 61 determines occurrence of the jam. "Occurrence of a jam" may be indicated when the belt platen 12 has reached the preset lower limit position. In a case where such a timing of indicating occurrence of a jam is adopted, even if an operator opens the door 53 for the jam processing immediately after indication of occurrence of the jam, the belt platen 12 has been already placed at the jam processing operating position which is the lower limit position. As a result, it is possible to prevent the operator from opening the door 53 during downward movement of the belt platen 12.

When the operator opens the door 53 during downward movement of the belt platen 12, the door opening/closing sensor 54 detects opening of the door 53 and transmits its door opening detection signal to the door opening/closing judgment portion 64. The door opening/closing judgment portion 64 determines that the door 53 is opened based on the door opening detection signal from the door opening/closing sensor 54. The main control portion 60 issues a forcible stop command or a forcible reduction command to the suction fan control portion 62. As a result, the suction fan 18 forcibly stops rotational driving. Alternatively, the suction fan 18 forcibly reduces the number of revolutions. Consequently, it is possible to improve safety when the door 53 is opened during downward movement of the belt platen 12.

According to the first embodiment, while the belt platen 12 is moved down toward the preset lower limit position after detection of a jam, the suction fan control portion 62 maintains the same number of revolutions as that during the recording operation, thereby rotating the suction fan 18. The present invention is not restricted thereto, and the number of revolutions of the suction fan 18 may be controlled as follows.

For example, while the belt platen 12 is moved down to separate the respective inkjet recording heads 7 to 10 from the belt platen 12, the suction fan control portion 62 may increase the number of revolutions of the suction fan 18 to be larger than the number of revolutions during the image recording, and may increase a suction force to be larger than a suction force during the image recording operation.

While the belt platen 12 is moved down to separate the respective inkjet recording heads 7 to 10 from the belt platen 12, the suction fan control portion 62 reduces the number of revolutions of the suction fan 18 to be smaller than the number of revolutions during the image recording. In this case, the suction fan control portion 62 may set the number of revolutions of the suction fan 18 corresponding to a suction force which can sufficiently suck the jammed recording medium onto the carrying belt 17.

In the first embodiment, when the belt platen 12 reaches the lower limit position and the respective inkjet recording heads 7 to 10 are thereby separated from the belt platen 12 with the preset gap therebetween, the suction fan control portion 62 stops rotation of the suction fan 18. The present invention is not restricted thereto. The suction fan control portion 62 may set the number of revolutions of the suction fan 18 to be small and reduce a suction force with respect to the recording medium 11 to be smaller than a suction force during the recording operation.

Moreover, the suction fan control portion 62 may set the number of revolutions of the suction fan so that the same number of revolutions as that during the image recording can be achieved. As a result, a suction force on the carrying belt 17 is restored to a suction force during the image recording.

It is to be noted that a judgment is made upon whether the belt platen 12 has been moved down to reach the lower limit position by the lower limit position sensor 47 in the first embodiment. When the belt platen has reached the lower limit position, the number of revolutions of the suction fan 18 is reduced, or rotation of the suction fan 18 is stopped. The present invention is not restricted thereto, and a timing of reducing the number of revolutions of the suction fan 18 may be set as follows.

For example, a timer which measures a time after start of downward movement of the platen 12 is provided. The suction fan control portion 62 receives a time measured by the timer. The suction fan control portion 62 judges whether a predetermined time has elapsed from start of downward movement of the belt platen 12 by the platen elevating mechanism 19 based on the time measured by the timer. The predetermined time is a time required for the belt platen 12 to move down from a regular image recording enabled position and reach the lower limit position so that the jam processing can be performed. After the predetermined time has elapsed from start of downward movement of the belt platen 12 by the platen elevating mechanism 19 based on the time measured by the timer, the suction fan control portion 62 sets the number of revolutions of the suction fan 18 to be small. As a result, a suction force obtained by rotation of the suction fan 18 is reduced.

That is, when the main control portion 60 outputs a downward movement start command to the platen elevating mechanism 19, the timer starts counting. The belt platen 12 moves down until a count time by the timer reaches the predetermined time. When the predetermined time is elapsed, the main control portion 60 controls the suction fan control portion 62 to reduce the number of revolutions of the suction fan 18. As a result, a suction force obtained by rotation of the suction fan 18 is reduced.

A second embodiment according to the present invention will now be described with reference to the accompanying drawings. It is to be noted that the entire configuration of an inkjet recording apparatus is the same as that shown in FIGS. 1 and 2, thereby obviating its detailed explanation.

Figure 7:
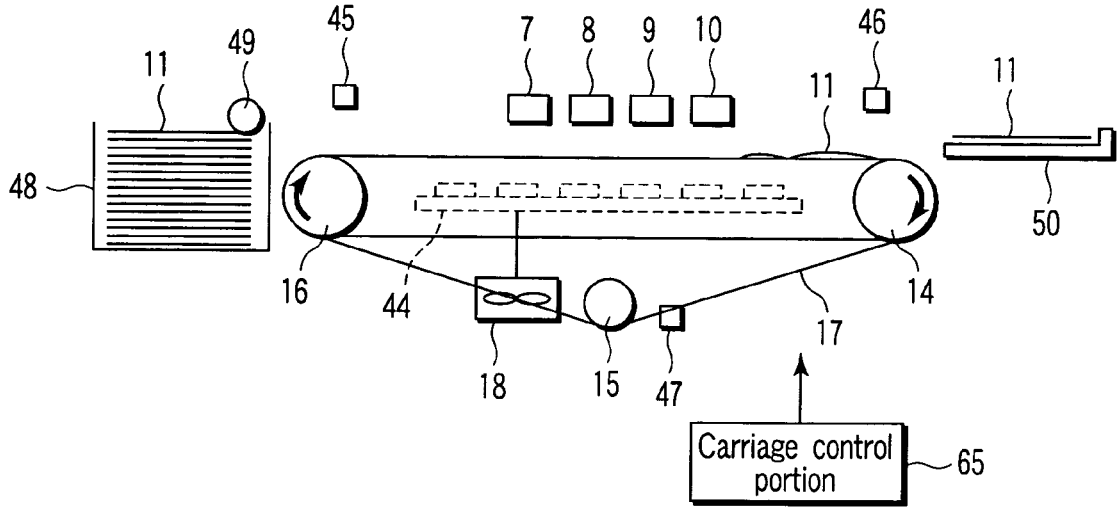
FIG. 7 is a block diagram showing a second embodiment of the inkjet recording apparatus according to the present invention.

FIG. 7 is a block diagram showing a primary part of an inkjet recording apparatus. This drawing shows a state where a belt platen 12 is placed at a lower limit position. It is to be noted that the respective ink tanks 30 to 33, the respective ink reservoirs 34 to 37, the respective distributors 38 to 41, the door opening/closing sensor 54, the main control portion 60, the paper jam detection portion 61, the suction fan control portion 62 and the indicating portion 63 depicted in FIG. 2 are eliminated in this drawing.

After a belt platen 12 is moved down and respective inkjet recording heads 7 to 10 are thereby separated from the belt platen 12 with a preset gap therebetween, a carriage control portion 65 issues a carriage start command to the belt platen 12 to perform a carriage operation of a carrying belt 17. Thereafter, a second paper sensor 46 detects a recording medium 11 and outputs a second detection signal. A main control portion 60 receives the second detection signal and outputs a carriage stop command. Upon receiving the carriage stop command from the main control portion 60, the carriage control portion 65 issues the carriage stop command to the belt platen 12 to stop the carriage operation of the carrying belt 17.

Figure 8:
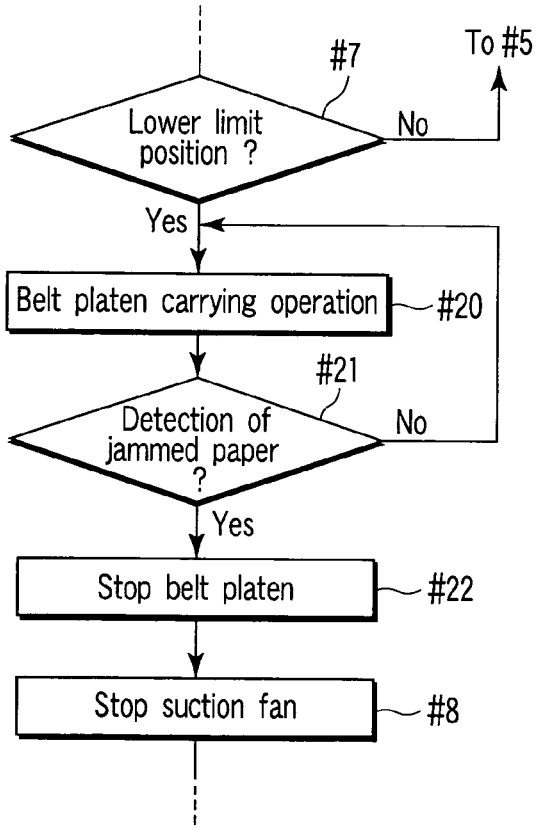
FIG. 8 is a jam processing flowchart in the apparatus.

Jam processing of the thus configured apparatus will now be described with reference to a jam processing flowchart of FIG. 8. The steps #1 to #6 and the steps #9 to #12 are the same as those in the jam processing flowchart of FIG. 4 and therefore will not be described.

When the recording medium 11 jams between the respective inkjet recording heads 7 to 10 and the belt platen 12 to produce a paper jam, the main control portion 60 moves down the belt platen 12. At a step #7, the main control portion 60 judges whether the belt platen 12 has reached a lower limit position. When the belt platen 12 reaches the lower limit position, the main control portion 60 issues a carriage start command to the carriage control portion 65 at a step #20.

It is to be noted that the main control portion 60 issues a suction force maintenance command to a suction fan control portion 62 immediate after occurrence of a jam. The suction fan control portion 62 maintains the number of revolutions of a suction fan 18 set immediately before receiving the suction force maintenance command. As a result, the suction fan 18 maintains rotation with the same number of revolutions as that during a recording operation. A suction force which sucks the recording medium 11 on the carrying belt 17 is maintained as it is. Therefore, during a downward movement operation of the belt platen 12, the recording medium 11 is sucked on the carrying belt 17.

When the belt platen 12 reaches the lower limit position and the carriage control portion 65 receives a carriage start command from the main control portion 60, the carriage control portion 65 rotates a platen driving motor 42 based on the carriage start command. The carriage control portion 65 sets the number of revolutions of the platen driving motor 42 in such a manner that a carrying speed of the recording medium 11 becomes an image recording speed. A driving roller 14 rotates by rotational driving of the platen driving motor 42. The carrying belt 17 moves at a fixed speed in a state where it is stretched between respective rollers 14 to 16 in response to rotation of the driving roller 14.

At this time, the suction fan control portion 62 continuously maintains the number of revolutions of the suction fan 18 set immediately before receiving the suction force maintenance command as described above. As a result, the suction fan 18 continues rotation with the same number of revolutions as that during the recording operation. Therefore, a suction force of sucking the recording medium 11 on the carrying belt 17 is maintained as it is.

In this state, the jammed paper sheet 11 is sucked and held on the carrying belt 17 by air suction. The jammed paper sheet 11 is carried to a downstream (ejection) side at a fixed speed by movement of the carrying belt 17. At this time, the respective inkjet recording heads 7 to 10 are sufficiently separated from the belt platen 12. During carriage, the jammed paper sheet 11 does not come into contact with the respective inkjet recording heads 7 to 10. The jammed paper sheet 11 is carried into, e.g., an ejection box dedicated to jammed paper sheets in an apparatus main body or an ejection tray dedicated to jammed paper sheets outside the apparatus main body.

When the jammed paper sheet 11 is carried to the downstream (ejection) side, the second paper sensor 46 detects the jammed recording medium 11 and outputs a second detection signal. The second detection signal is transmitted to the main control portion 60.

Upon receiving the second detection signal from the second paper sensor 46, the main control portion 60 issues a carriage stop command to the carriage control portion 65. In response to this command, the belt platen 12 stops movement of the carrying belt 17.

At a step #8, the main control portion 60 issues a suction stop command to the suction fan control portion 62. The suction fan 18 stops its rotation. Suction and holding of the recording medium 11 on the carrying belt 17 are released.

Then, an operator opens a door 53. The operator removes the jammed recording medium 11 through an ejection opening of the apparatus main body.

As described above, according to the second embodiment, the respective inkjet recording heads 7 to 10 are separated from the belt platen 12 with the predetermined gap therebetween, and the belt platen 12 is then operated to carry the recording medium 11 jammed between the respective inkjet recording heads 7 to 10 and the belt platen 12 to the downstream side.

The respective inkjet recording heads 7 to 10 are the most important components for the inkjet recording apparatus. An operator can perform processing of removing the jammed recording medium 11 at a position apart from the respective inkjet recording heads 7 to 10. A possibility of contact of the recording medium 11 with respect to the respective inkjet recording heads 7 to 10 during the processing of removing the jammed recording medium 11 can be reduced as compared with the first embodiment.

A third embodiment according to the present invention will now be described with reference to the accompanying drawings. The entire configuration of an inkjet recording apparatus is the same as that shown in FIGS. 1 and 2, thereby no detailed explanation of it is given.

Figure 9:
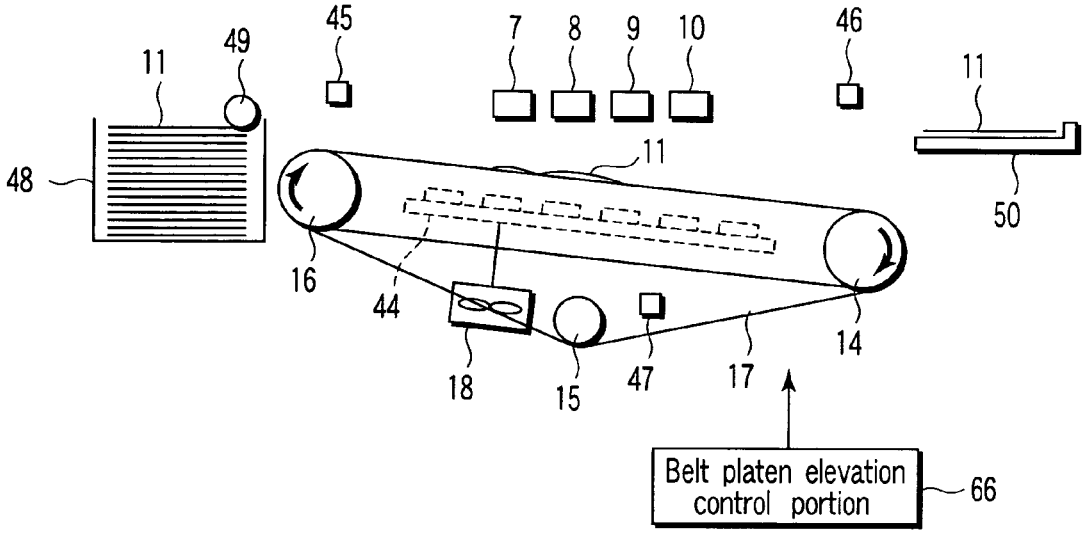
FIG. 9 is a block diagram showing a third embodiment of the inkjet recording apparatus according to the present invention.

FIG. 9 is a block diagram of a primary part of an inkjet recording apparatus. A belt platen elevating mechanism 19 inclines a belt platen 12 to separate respective inkjet recording heads 7 to 10 from the belt platen 12.

The belt platen 12 is inclined by, e.g., swiveling the other platen support arm 25 alone depicted in FIG. 1 in a direction indicated by an arrow C (a counterclockwise direction). A technique of swiveling the other platen support arm 25 alone is as follows. For example, coupling of a platen rotation driving shaft 20 and one platen support arm 24 is released by a clutch 20*a*. As a result, movement of a driving belt 23 is transmitted to the other platen support arm 25 alone through a platen rotation driven shaft 21.

Therefore, the belt platen elevating mechanism 19 releases the clutch 20*a* which couples the platen rotation driving shaft 20 with one platen support arm 24. In this state, the belt platen elevating mechanism 19 rotates an elevation driving motor 22 for a predetermined time only. An inclination angle of the belt platen 12 is set based on a rotation angle of the other platen support arm 25. When a time in which the elevation driving motor 22 is rotated is set in advance, the belt platen 12 is inclined at a predetermined inclination angle.

It is to be noted that inclination of the belt platen 12 couples a motor with the belt platen driven shaft 21. It is also possible to provide a mechanism which moves a driving belt 23 wound around the platen rotation driven shaft 21 apart from the platen rotation driving shaft 20 by driving of the motor.

Jam processing of the thus configured apparatus will now be described.

During an image recording operation, a recording medium 11 is sucked and carried on a carrying belt 17. In this state, when the recording medium 11 jams between respective inkjet recording heads 7 to 10 and the carrying belt 17, a main-control portion 60 issues a downward movement start command to the belt platen elevating mechanism 19.

The belt platen elevating mechanism 19 releases coupling of the platen rotation driving shaft 20 and one platen support arm 24. In this state, the belt platen elevating mechanism 19 rotates the elevation driving motor 22 for a predetermined time. When the elevation driving motor 22 is driven to rotate, the platen rotation driving shaft 20 is rotated. The driving belt 23 is driven in response to rotation of the platen rotation driving shaft 20. At this time, since coupling of the platen rotation driving shaft 20 and one platen support arm 24 has been released, one platen support arm 24 does not swivel.

The platen rotation driven shaft 21 rotates in response to driving of the driving belt 23. The other platen support arm 25 swivels around the platen rotation driven shaft 21 along a direction indicated by an arrow C with rotation of the platen rotation driven shaft 21. As a result, as shown in FIG. 9, a downstream (ejection) side of the belt platen 12 mounted at an end portion of the platen support arm 25 is moved down with an end portion of one platen support arm 24 being used as a supporting point. During downward movement of the belt platen 12, a suction fan control portion 62 maintains the number of revolutions of a suction fan 18. The jammed recording medium 11 is sucked on the carrying belt 17.

When a predetermined time elapses from start of driving of the elevation driving motor 22, the elevation driving motor 22 stops. As a result, the belt platen 12 stops in a state where the predetermined inclination angle is maintained.

When the predetermined time elapses from start of driving of the elevation driving motor 22, the suction fan control portion 62 stops the number of revolutions of the suction fan. As a result, a suction force on the carrying belt 17 becomes zero.

In this state, an operator opens a door 53. The belt platen 12 is largely separated from the respective inkjet recording heads 7 to 10 since the downstream (ejection) side of the belt platen 12 has moved down. The operator inserts through the opening 52 his/her hand into a space between the belt platen 12 and the respective inkjet recording heads 7 to 10 which are greatly separated from each other. The operator removes the jammed recording medium 11 present on the carrying belt 17.

After removing the jammed recording medium 11, the operator closes the door 53. When the door 53 is closed, a door opening/closing sensor 54 detects closing of the door 53, and outputs a door closing detection signal. A door opening/closing judgment portion 64 receives the door closing detection signal and determines that the door 53 is closed. The main control portion 60 issues an upward movement start command to the belt platen elevating mechanism 19. A belt platen elevation control portion 66 rotates the elevation driving motor 22 in a reverse direction for a predetermined period in a state where coupling of the platen rotation driving shaft 20 and one platen support arm 24 is released. As a result, the platen rotation driving shaft 20 rotates in the reverse direction. The driving belt 23 is driven in the reverse direction in response to reverse rotation of the platen rotation driving shaft 20.

The platen rotation driven shaft 21 rotates in the reverse direction in response to driving of the driving belt 23 in the reverse direction. The other platen support arm 25 swivels around the platen rotation driven shaft 21 in a direction (a clockwise direction) opposite to a downward direction indicated by the arrow C with rotation of the platen rotation driven shaft 21. As a result, the downstream (ejection) side of the belt platen 12 moves up with the end portion of one platen support arm 24 being used as a supporting point.

When the elevation driving motor 22 rotates for a predetermined time and then stops, the belt platen 12 stops at a regular recording operation position.

As described above, according to the third embodiment, the downstream (ejection) side of the belt platen 12 is moved down and inclined, and the respective inkjet recording heads 7 to 10 are separated from the belt platen 12. An operator opens the door 53, as in the foregoing embodiments. The operator inserts, e.g., his/her hand through an opening 52 into a space between the belt platen 12 and the respective inkjet recording heads 7 to 10 which are largely separated from each other due to downward movement of the downstream (ejection) side. The operator can readily remove the jammed recording medium 11 present on the carrying belt 17 of the belt platen 12.

A fourth embodiment according to the present invention will now be described with reference to the accompanying drawings. It is to be noted that the entire configuration of the inkjet recording apparatus is substantially the same as that shown in FIGS. 1 and 2, thereby obviating its detailed explanation.

Figure 10:
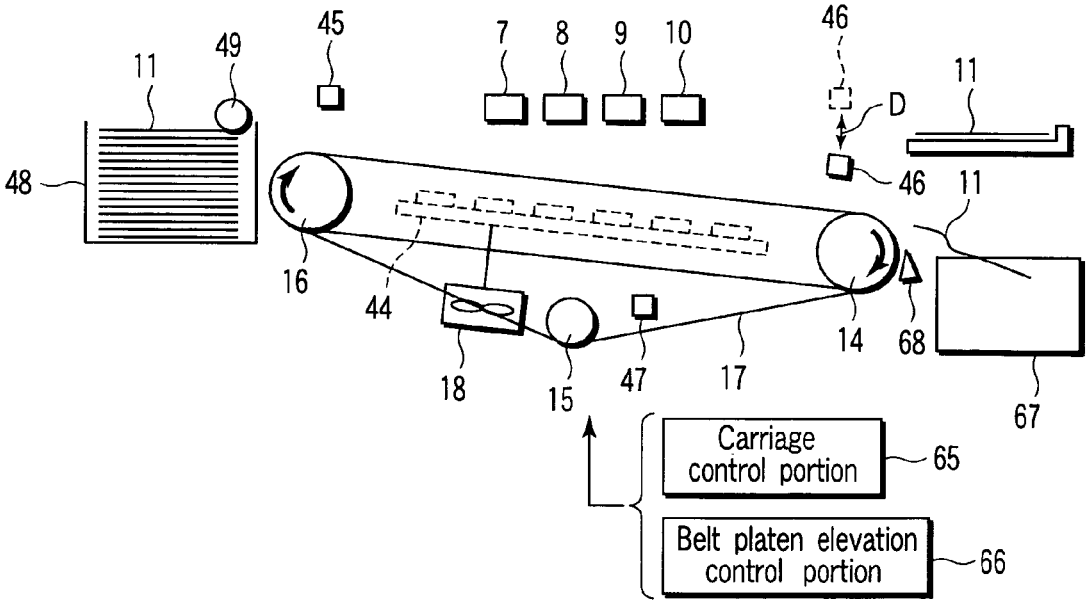
FIG. 10 is a block diagram showing a fourth embodiment of the inkjet recording apparatus according to the present invention.

FIG. 10 is a block diagram showing a primary part of an inkjet recording apparatus. This drawing shows a state where a downstream (ejection) side alone of a belt platen 12 is moved down. A paper acceptor 67 is provided on the downstream (ejection) side of the belt platen 12. The paper acceptor 67 accommodates jammed recording mediums 11. An opening is provided at an upper portion of the paper acceptor 67. The downstream (ejection) side of the belt-platen 12 is in a lowered and inclined state. In this state, the opening of the paper acceptor 67 is provided at a height position which is a position slightly lower than an upper surface position of a carrying belt 17 on the downstream (ejection) side.

A stripping lever 68 is provided on the downstream (ejection) side of the carrying belt 17. The downstream (ejection) side of the belt platen 12 is in a lowered and inclined state. In this state, the stripping lever 68 is aligned with a driving roller 14. The stripping lever 68 strips off the jammed paper sheet 11 sucked and held on the carrying belt 17.

A second paper sensor 46 moves up and down in the direction indicated by an arrow D with inclination of the belt platen 12.

Jam processing of the thus configured apparatus will now be described.

During an image recording operation, the recording medium 11 is sucked and carried on the carrying belt 17. When the recording medium 11 jams between respective inkjet recording heads 7 to 10 and the carrying belt 17 in this state, a main control portion 60 issues a downward movement start command to a belt platen elevating mechanism 19.

The belt platen elevating mechanism 19 releases coupling of a platen rotation driving shaft 20 and one platen support arm 24. In this state, the belt platen elevating mechanism 19 rotates an elevation driving motor 22 for a predetermined time. As a result, the downstream side alone of the belt platen 12 moves down like the third embodiment.

The main control portion 60 issues a suction force maintenance command to a suction fan control portion 62 immediately after occurrence of a jam. The suction fan control portion 62 maintains the number of revolutions of a suction fan 18 set immediately before receiving the suction force maintenance command. As a result, the suction fan 18 continues rotation with the same number of revolutions as that during a recording operation. A suction force of sucking the recording medium 11 on the carrying belt 17 is maintained as it is. Therefore, during the downward movement operation of the downstream side of the belt platen 12, the recording medium 11 is sucked on the carrying belt 17.

When a predetermined time elapses after downward movement of the downstream side of the belt platen 12, the belt platen elevating mechanism 19 stops the elevation driving motor 22. As a result, the belt platen 12 stops the downward movement. Consequently, the belt platen 12 maintains the inclined state.

Then, the main control portion 60 issues a carriage start command to a carriage control portion 65. Upon receiving the carriage start command, the carriage control portion 65 drives a platen driving motor 42 of the belt platen 12. A driving roller 14 rotates by driving of the platen driving motor 42. As a result, the carrying belt 17 rotates at a fixed speed in a state where it is stretched between respective rollers 14 to 16.

When the belt platen 12 is moving down and when the carrying belt 17 is moving, the main control portion 60 keeps issuing a suction force maintenance command to the suction fan control portion 62. The suction fan control portion 62 maintains the number of revolutions of the suction fan 18 set immediately before receiving the suction force maintenance command. As a result, the suction fan 18 continues rotation with the same number of revolutions as that during a recording operation. Consequently, a suction force of sucking the recording medium 11 on the carrying belt 17 is maintained as it is.

Therefore, the jammed recording medium 11 is carried toward the downstream (ejection) side with movement of the carrying belt 17 in a state where the recording medium 11 is sucked and held on the carrying belt 17. At this time, the respective inkjet recording heads 7 to 10 are separated from the belt platen with a preset gap therebetween. The jammed recording medium 11 does not come into contact with the respective inkjet recording heads 7 to 10.

The jammed paper sheet 11 passes through a detection area below the second paper sensor 46. At this time, the second paper sensor 46 detects the jammed paper sheet 11, and outputs a second detection signal. The main control portion receives the second detection signal, and issues a carriage stop command to the carriage control portion 65 and also issues a suction stop command to the suction fan control portion 62 when a predetermined time has elapsed from acceptance of the second detection signal. As a result, the carrying belt 17 stops movement. The suction fan 18 stops rotation.

As a result, when the jammed paper sheet 11 passes through a set position of the stripping lever 68, the carrying belt 17 stops movement. The jammed paper sheet 11 is stripped off from the carrying belt 17 by the stripping lever 68. The stripped jammed paper sheet 11 is accommodated in the paper acceptor 67.

As described above, according to the fourth embodiment, the downstream (ejection) side of the belt platen 12 is lowered and inclined, the respective inkjet recording heads 7 to 10 are separated from the belt platen 12, and then the carrying belt 17 is moved to carry the jammed recording medium 11 toward the downstream side and accommodate it in the paper acceptor 67.

An operator does not have to insert his/her hand into a space between the respective inkjet recording heads 7 to 10 and the belt platen 12 in order to remove a jammed paper sheet. The jammed recording medium 11 can be automatically ejected from the space between the respective inkjet recording heads 7 to 10 and the belt platen 12 and accommodated in the paper acceptor 67.

It is to be noted that the present invention is not restricted to the foregoing embodiments and can be modified as follows.

For example, at the time of occurrence of a jam, the indicating portion 63 may indicate a position of the jammed paper sheet 11, e.g., an upstream side, a central part and a downstream side of the carrying belt 17. In this case, positional detection of the jammed paper 11 is possible by, e.g., arranging a plurality of paper sensors along a carrying direction of the carrying belt 17. Positional detection of the jammed paper sheet 11 can be obtained based on a time from detection of the recording medium 11 by the first paper sensor 45 to occurrence of a jam and a carrying speed of the carrying belt 17.

A suction force with respect to the recording medium 11 on the carrying belt 17 is set in accordance with the number of revolutions of the suction fan 18. The suction force with respect to the recording medium 11 on the carrying belt 17 may be increased/decreased in accordance with a thickness or the like of the recording medium 11. For example, a large suction force is set with respect to the recording medium 11 having a large paper thickness. As a result, the jammed paper sheet is assuredly sucked and held on the carrying belt 17. In a state where the jammed paper sheet 11 is assuredly sucked on the carrying belt 17, a downward movement operation can be performed.

The present invention is not restricted to moving down the belt platen 12. The respective inkjet recording heads 7 to 10 may be moved up. As a result, the respective inkjet recording heads 7 to 10 and the belt platen 12 can be separated from each other with the preset gap therebetween.

As a technique of sucking the jammed paper sheet 11 onto the carrying belt 17 during downward movement of the belt platen 12, the suction fan 18 provided in the belt platen 12 is driven, but the present invention is not restricted thereto. Any structure can be adopted as long as the jammed paper sheet 11 can be pressed against the carrying belt 17. For example, one or more air sending nozzles may be provided. Each air sending nozzle is arranged on, e.g., the respective inkjet recording heads 7 to 10 side. Each air sending nozzle blows air toward the belt platen 12. As a result, the jammed paper sheet 11 is pressed against the carrying belt 17.

As a technique of sucking the jammed paper sheet 11 onto the carrying belt 17, static electricity may be generated on the carrying belt 17. The jammed paper sheet 11 is therefore sucked onto the carrying belt 17 by static electricity.

As a technique of sucking the jammed paper sheet 11 onto the carrying belt 17 during downward movement of the belt platen 12, the suction fan 18 which sucks and holds the recording medium 11 on the carrying belt 17 during image recording is also used, but a dedicated suction fan which sucks the jammed paper sheet 11 may be provided.

The above has described the removal of the jammed paper sheet 11 at the time of occurrence of a jam as jam processing in the foregoing embodiments. Each of the foregoing embodiments can be also applied to a case where paper raise occurs in the recording medium 11 to be carried even though a jam is not produced. As to paper raise of the recording medium 11, when the recording medium 11 is carried in a paper raised state, a jam occurs. That is, generation of a paper raised part which is equal to or greater than a predetermined size in the recording medium 11 to be carried is detected. The paper raise of the recording medium 11 can be detected by arranging a contact sensor or the like above the carrying belt 17, for example. When the paper raise is detected, movement of the carrying belt 17 is stopped, as in the foregoing embodiments. The belt platen 12 is moved down. As a result, the recording medium 11 in which the paper raise is generated is removed.

Although the above has described each of the foregoing embodiments which continuously rotates the suction fan 18 to suck the jammed recording medium 11 onto the carrying belt 17 during the separating operation of the belt platen 12, the present invention is not restricted thereto. For example, rotation of the suction fan 18 may be stopped during the separating operation of the belt platen 12. That is, a suction force is produced when the separating operation of the belt platen 12 is started, but rotation of the suction fan 18 may be stopped even during the separating operation of the belt platen 12 if the jammed recording medium 11 is assuredly sucked on the carrying belt 17. Even if the suction force is lost during the separating operation of the belt platen 12, the jammed recording medium 11 remains on the carrying belt 17 due to its own weight. As a result, the recording medium 11 moves down together with the belt platen 12.

If the suction force can be generated in this manner when at least the separating operation of the belt platen 12 is started, the jammed recording medium 11 can be drawn toward the belt platen 12 side. Additionally, even if the suction force is stopped during the separating operation, the jammed recording medium 11 as well as the belt platen 12 can be separated from the inkjet recording heads, whereby the recording medium 11 can be mounted on the carrying belt 17.

Further, generation of the suction force is stopped during or immediately after start of the separating operation of the belt platen 12 after occurrence of a jam, but it is possible to generate a suction force which can suck the jammed recording medium onto the carrying belt 17 even after the belt platen 12 is separated from the inkjet recording heads to some extent. In this manner, as a period in which a suction force of sucking the jammed recording medium 11 onto the carrying belt 17, the following respective patterns can be considered.

There are (1) a period from start to midstream of the separating operation of the belt platen 12, (2) a period from start to end of the separating operation of the belt platen 12, (3) a period from midstream to end of the separating operation of the belt platen 12, and (4) a period of midstream of the separating operation of the belt platen 12 excluding start and end of the separating operation of the same.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A jam processing apparatus for a printer, comprising:

a recording head which records an image on a recording medium;

a carrying belt which is arranged to face the recording head and which carries the recording medium, wherein the carrying belt includes a recording medium holding surface on which the recording medium is held, and a plurality of suction holes are formed in the recording medium holding surface;

a carrying belt driving portion which moves the carrying belt in at least a direction separating from the recording head;

a suction fan which takes in air from the plurality of suction holes to suck the recording medium onto the recording medium holding surface of the carrying belt; and a sensor which detects a carriage defect of the recording medium, wherein:

when the sensor detects the carriage defect of the recording medium, the carrying belt stops carrying the recording medium, and the carrying belt driving portion moves the carrying belt in the direction separating from the recording head, during a period of a separating operation in which the carrying belt driving portion moves the carrying belt in the direction separating from the recording head, the suction fan takes in air from the plurality of suction holes to suck the recording medium onto the recording medium holding surface of the carrying belt, and the recording medium separates from the recording head along with the carrying belt.

2. The jam processing apparatus for the printer according to claim 1, wherein a suction force of the suction fan when the carrying belt is being separated from the recording head is equal to a suction force of sucking the recording medium during recording of the image on the recording medium.

3. The jam processing apparatus for the printer according to claim 1, wherein the suction fan continues to take in air from a time of recording of the image on the recording medium until completion of the separating operation of separating the carrying belt from the recording head, and keeps the recording medium sucked onto the recording medium holding surface of the carrying belt.

4. The jam processing apparatus for the printer according to claim 1, wherein when the carrying belt is separated from the recording head in the separating operation by the carrying belt driving portion and reaches a position at which jam processing is possible, the suction fan reduces a suction force with respect to the recording medium holding surface.

5. The jam processing apparatus for a printer according to claim 4, wherein when the carrying belt is separated from the recording head in the separating operation by the carrying belt driving portion and reaches the position at which jam processing is possible, the suction fan stops driving and sets the suction force to zero.

6. The jam processing apparatus for a printer according to claim 1, wherein when the carrying belt is separated from the recording head in the separating operation by the carrying belt driving portion and a predetermined time elapses from start of the separating operation, the suction fan reduces a suction force with respect to the recording medium holding surface.

7. The jam processing apparatus for a printer according to claim 6, wherein when the carrying belt is separated from the recording head in the separating operation by the carrying belt driving portion and the predetermined time elapses from start of the separating operation, the suction fan stops driving and sets the suction force to zero.

8. The jam processing apparatus for a printer according to claim 1, wherein when the carrying belt is separated from the recording head in the separating operation by the carrying belt driving portion and reaches a position at which jam processing is possible, the carrying belt carries the recording medium sucked on the recording medium holding surface.

9. The jam processing apparatus for a printer according to claim 1, further comprising an indicating portion which indicates occurrence of the carriage defect of the recording medium, wherein the indicating portion indicates occurrence of the carriage defect of the recording medium after the carrying belt is separated from the recording head by the carrying belt driving portion and reaches a position at which jam processing is possible.

10. The jam processing apparatus for a printer according to claim 1, further comprising an indicating portion which indicates that jam processing is possible, wherein the indicating portion indicates that jam processing is possible after the carrying belt is separated from the recording head by the carrying belt driving portion and reaches a position at which jam processing is possible.

11. The jam processing apparatus for a printer according to claim 1, wherein the suction fan exerts a suction force onto the recording medium in a period from start of the separating operation to midstream of the separating operation of the carrying belt.

12. The jam processing apparatus for a printer according to claim 1, wherein the suction fan exerts a suction force onto the recording medium in a period from midstream of the separating operation to end of the separating operation of the carrying belt.

13. A jam processing method for a printer, comprising:

sucking a recording medium onto a recording medium holding surface of a carrying belt, wherein a plurality of suction holes are formed in the recording medium holding surface;

carrying the recording medium to a position facing a recording head;

recording an image on the carried recording medium by the recording head while the recording medium is being carried;

detecting whether a carriage defect of the recording medium has occurred; and when the carriage defect is detected, performing a separating operation of separating the carrying belt in a direction separating from the recording head and taking in air from the plurality of suction holes during the separating operation, thereby sucking the recording medium onto the recording medium holding surface of the carrying belt, and separating the recording medium from the recording head along with the carrying belt.

14. The jam processing method for the printer according to claim 13, wherein when the carrying belt is being separated from the recording head, a suction force of sucking the recording medium onto the recording medium holding surface is at least equal to a suction force of sucking the recording medium during the recording of the image on the recording medium.

15. The jam processing method for the printer according to claim 14, wherein the suction force is reduced when the carrying belt is separated from the recording head and reaches a position at which jam processing is possible.

16. The jam processing method for the printer according to claim 15, wherein after the suction force is reduced, an operator is informed of a fact that the carriage defect has occurred or that jam processing is possible.

17. The jam processing method for the printer according to claim 14, wherein when the carrying belt is separated from the recording head and reaches a position at which jam processing is possible, the carrying belt is driven to eject the recording medium which has caused jamming.

* * * * *